US009322301B2

(12) United States Patent
Thiessen

(10) Patent No.: US 9,322,301 B2
(45) Date of Patent: Apr. 26, 2016

(54) METHOD OF EXTERNALLY MODIFYING A CARNOT ENGINE CYCLE

(76) Inventor: Robert Thiessen, Calgary (CA)

( * ) Notice: Subject to any disclaimer, the term of this patent is extended or adjusted under 35 U.S.C. 154(b) by 425 days.

(21) Appl. No.: 12/866,379

(22) PCT Filed: Feb. 9, 2009

(86) PCT No.: PCT/CA2009/000167

§ 371 (c)(1),
(2), (4) Date: Aug. 5, 2010

(87) PCT Pub. No.: WO2009/097698

PCT Pub. Date: Aug. 13, 2009

(65) Prior Publication Data

US 2010/0313558 A1 Dec. 16, 2010

(30) Foreign Application Priority Data

Feb. 7, 2008 (CA) ..... 2621624

(51) Int. Cl.
*F01K 25/08* (2006.01)
*F01K 25/10* (2006.01)

(52) U.S. Cl.
CPC ..... *F01K 25/10* (2013.01)

(58) Field of Classification Search
USPC ..... 60/517, 516, 651, 671, 645, 681
See application file for complete search history.

(56) References Cited

U.S. PATENT DOCUMENTS

| | | | | |
|---|---|---|---|---|
| 4,179,890 | A | 12/1979 | Hanson | |
| 4,907,410 | A * | 3/1990 | Chang | 60/641.6 |
| 5,027,602 | A * | 7/1991 | Glen et al. | 60/651 |
| 7,426,832 | B2 | 9/2008 | Paul | |
| 7,647,774 | B2 * | 1/2010 | Shirk et al. | 60/651 |
| 2005/0076639 | A1 * | 4/2005 | Shirk et al. | 60/520 |
| 2008/0216510 | A1 | 9/2008 | Vandor et al. | |

FOREIGN PATENT DOCUMENTS

| | | |
|---|---|---|
| AU | 2003260255 | 3/2004 |
| CA | 2371453 | 11/2000 |
| CA | 2652243 | 11/2007 |
| GB | 1398040 | 6/1975 |
| WO | WO 2004/020793 | 3/2004 |

* cited by examiner

*Primary Examiner* — Thomas Denion
*Assistant Examiner* — Kelsey Gambrel
(74) *Attorney, Agent, or Firm* — Davis & Bujold, P.L.L.C.; Michael J. Bujold

(57) ABSTRACT

A method of externally modifying a Carnot engine cycle. A first step involves providing a heat exchange path between an external environment and a fluid circulating in a carnot engine. A second step involving permitting the carnot engine to draw from an endless supply of heat or cold in the external environment to regenerate the Carnot engine cycle as entropic losses are encountered and as differential heat energy is converted into power.

20 Claims, 10 Drawing Sheets

METHOD OF EXTERNALLY MODIFYING A CARNOT ENGINE CYCLE

The present invention relates to a proposed modification to a Carnot engine cycle.

BACKGROUND

It can be mathematically demonstrated that heat supplied less heat discharged equals the maximum temperature less the minimum temperature in the cycle. In a theoretical Carnot engine cycle, differential heat energy is turned into power output by using working substances to transfer heat energy between a hot sink and a cold sink in a continuous loop. The continuous loop is an internal cycle, without external influence. In an actual Carnot engine cycle, the internal cycle is adversely effected by losses during heat transfer and conversion of heat energy into power output to perform work.

SUMMARY

There is provided a method of externally modifying a Carnot engine cycle. A first step involves providing a heat exchange path between an external environment and a fluid circulating in a carnot engine. A second step involving permitting the carnot engine to draw from an endless supply of heat or cold in the external environment to regenerate the Carnot engine cycle as entropic losses are encountered and as differential heat energy is converted into power.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
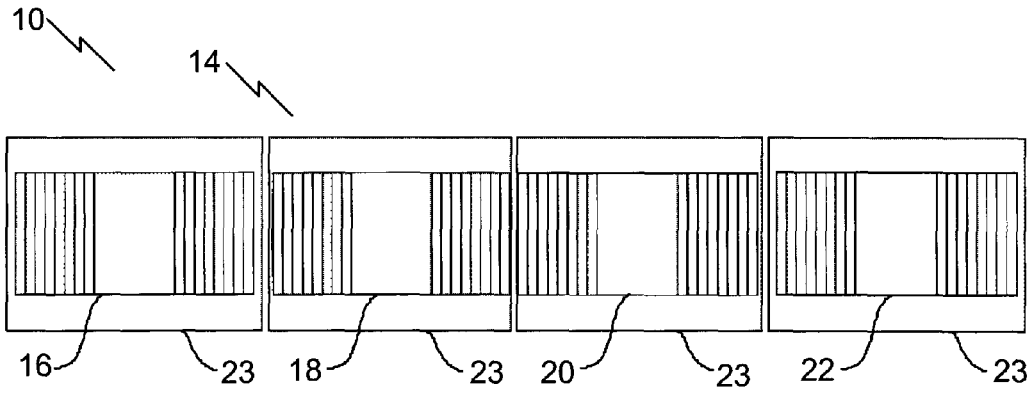
FIG. 1 is a side view in partial section of a carnot engine.

A first embodiment of a carnot engine generally identified by reference numeral 10, will now be described with reference to FIG. 1 through 11. This first embodiment represents a combination cycle in which two thermodynamic cycles are linked together in order to take advantage of complementary processes and the unique attributes of a variety of working substances. A second embodiment will then be discussed with reference to FIG. 9 and FIG. 12 through 17. The second embodiment represents a single thermodynamic cycle in which one working substance is expanded and compressed in a continuous cycle. As many of the same components are used but in a different order, similar reference numerals are used between the two embodiments.

Figure 2:
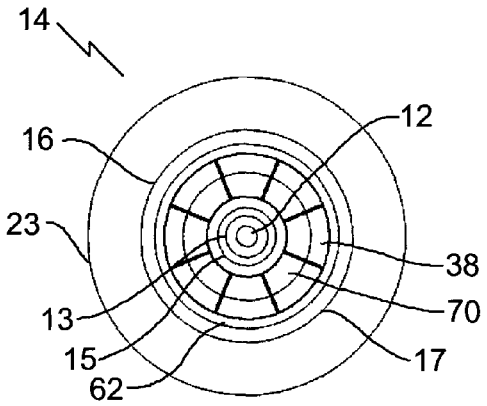
FIG. 2 is an end view in section of a cylindrical assembly of the carnot engine illustrated in FIG. 1.
Figure 3:
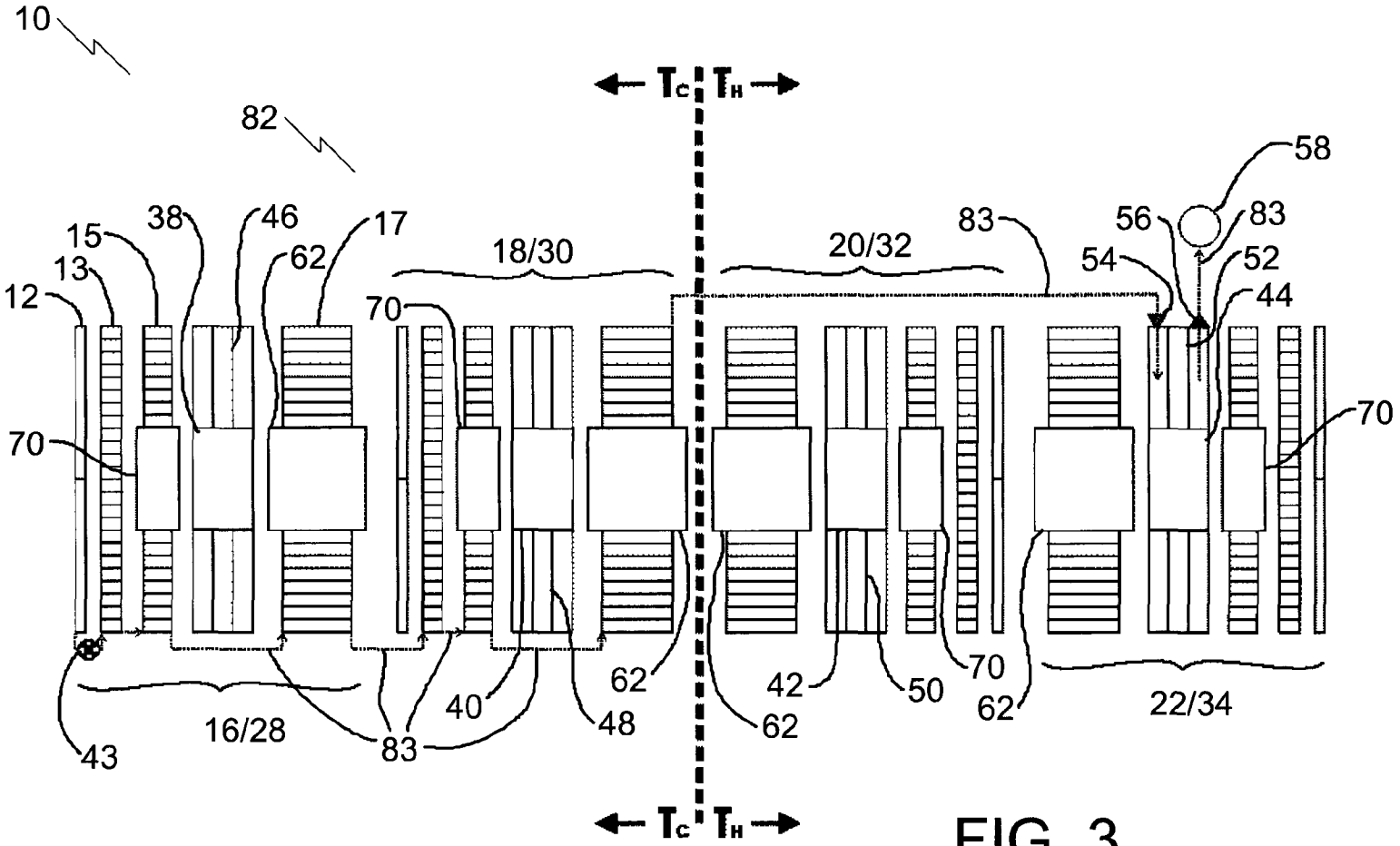
FIG. 3 is an exploded schematic view of the carnot engine, with the components rotated 90°, and depicting the first expansion flow path.

Structure and Relationship of Parts of a First Embodiment:

Referring to FIG. 3, carnot engine 10 has a cold source 12 in the form of a container holding a working substance. In the depicted embodiment, the working substance is a cryogenic liquid that goes from a liquid phase to a gas phase when heated, and from a gas phase to a liquid phase when cooled. It is to be understood that an elastic working substance could also perform the same function without undergoing phase change, whereby an ideal gas could be made to expand when heated and compress when cooled. In carnot engine 10, the working substance will undergo isobaric or isometric heating or cooling, and isothermal or adiabatic expansion or contraction, depending on the stage. Cold source 12 is a container holding the working substance in liquid or compressed form. There is a cylindrical assembly 14 made up of a series of axially spaced sections, namely a first section 16, a second section 18, a third section 20 and a fourth section 22. Each section is in an individually insulated compartment 23, and, referring to FIGS. 2 and 3, each section is formed of a series of concentric nested components. The main nested components include inner exchange tubes 13 and 15, outer exchange tubes 17, and the components to remove work from engine 10, namely piston pump 38, 40, 42 or 44, a flywheel 70, and a crank sleeve 62. Cold source 12 may be positioned at the centre of first section 16. Generally, as shown in FIGS. 1 and 3, the temperature of engine 10 increases from left to right, with the central component of each section having the most extreme temperature, either hot or cold. The components in FIG. 3 are shown in an exploded view, and rotated 90 degrees for clarity in the drawing.

Figure 5:
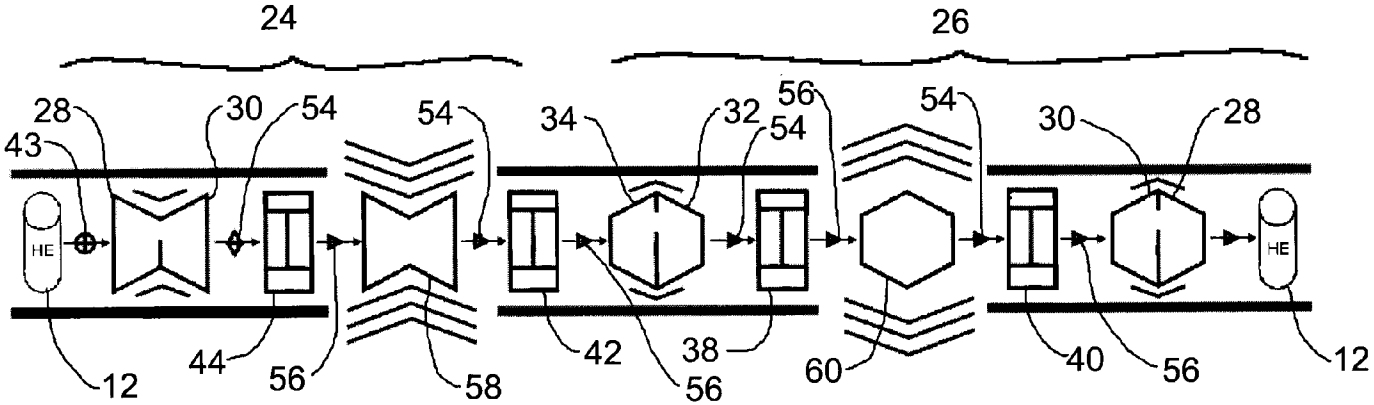
FIG. 5 is a flow chart of the cycle of a first working substance depicting paths based on heat.
Figure 6:
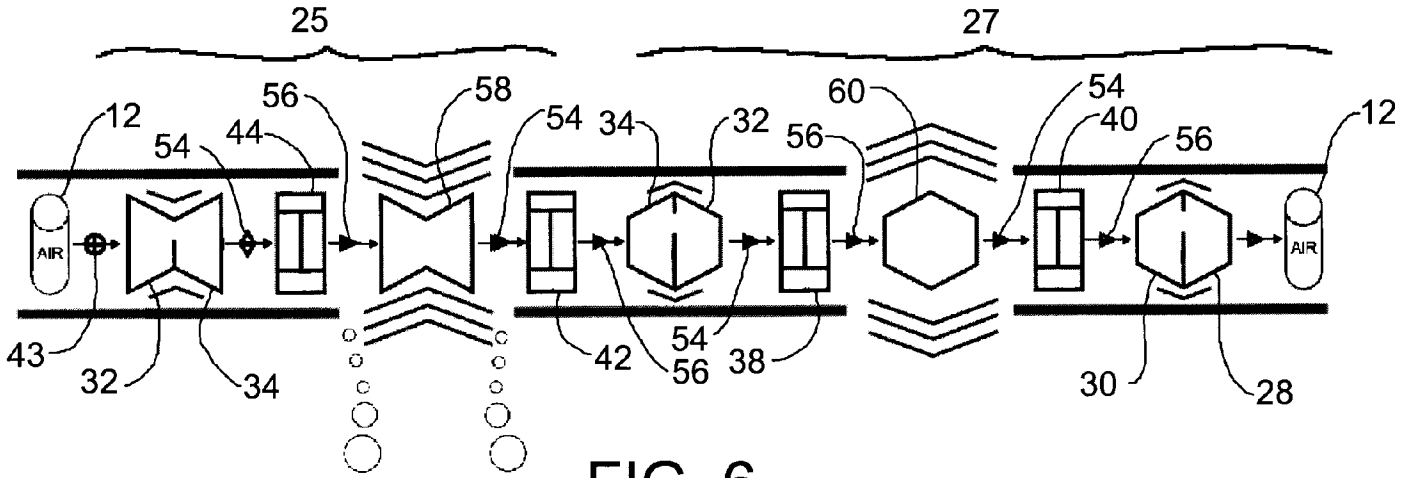
FIG. 6 is a flow chart of the cycle of a second working substance depicting paths based on heat.

Referring to FIG. 5 and FIG. 6, cylindrical assembly 14 is made up of four heat transfer paths. FIG. 5 and FIG. 6 are flow charts that represent the progression of working substances through engine 10. The relative position of each component is shown in FIG. 1 through 3. A first transfer path 24 circulates a first working substance through the series of axially spaced sections 16, 18, 20, 22 from cold sink 12 to a piston pump 42. Piston pump 42 serves as a heat source by compressing the gas, and produces the highest internal temperature within carnot engine 10. In this capacity, piston pump 42 may be referred to as heat pump 42. A second transfer path 26 circulates the first working substance through the series of axially spaced sections 16, 18, 20, 22 from heat pump 42 to cold source 12. A third transfer path 25 circulates a second working substance through the series of axially spaced sections 16, 18, 20, 22 from cold sink 12 to heat pump 42. A fourth transfer path 27 circulates the second working substance through the series of axially spaced sections 16, 18, 20, 22 from heat pump 42 to cold source 12.

There is also a series of primary heat exchangers, including a first primary heat exchanger 28, a second primary heat exchanger 30, a third primary heat exchanger 32 and a fourth primary heat exchanger 34 made up of exchange tubes 13, 15, 17. Heat exchangers 28, 30, 32, 34 correspond to sections 16, 18, 20, 22 and effect a heat exchange between transfer paths 24, 26, 25 and 27 to perpetuate the Carnot cycle by cooling in sequential stages the working substance flowing from heat pump 42 to cold sink 12, and heating in sequential stages the working substance flowing from cold sink 12 to heat pump 42. The actual heat exchanges that occur in the preferred embodiment are described in the example given below. It will be understood that, using the principles discussed herein, the actual cooling or heating path may include some intermediate steps that result in the working substance being heated as it flows from heat pump 42 to cold sink 12, or cooled as it flows from cold sink 12 to heat pump 42, so long as the overall cooling or heating trend along each respective path is maintained in the proper direction.

Figure 9:
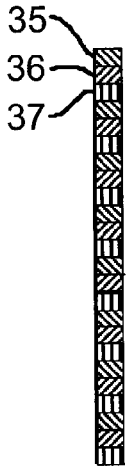
FIG. 9 is a detailed view of a heat exchanger component showing the various flow paths.

In the example shown and described below, each heat exchanger 28, 30, 32, 34 has three sub-paths. Referring to FIG. 9, the three sub-paths 35, 36, 37 are shown as alternating as they are wound together throughout inner exchange tube 13. The various sub-paths 35, 36, 37 within exchange tube 13 have been textured with different textures to indicate which sub-paths are connected. A similar winding may be found in each exchange tube 15 and 17. The actual design used to provide sub-paths 35, 36, 37 may be varied, and FIG. 9 is merely representative of one implementation. Each transfer path 24, 25, 26, 27 is made up of one of the sub-paths 35, 36, 37 in each heat exchanger 28, 30, 32, 34 to allow the working substances to remain physically separate while permitting thermal energy transfer to occur. Generally, the first and second sub-paths 35, 36 are used for sections where either the first or second working substance passes in both directions through that particular section, depending on the transfer path, while the third sub-path 37 is used for the other working substance, which only passes in one direction through that section. It will be understood that the actual number and position of flow paths may be modified, depending on the final implementation of engine 10.

Referring to FIG. 3, there are also a series of double acting piston pumps 38, 40, 42 and 44 that have movable members 46, 48, 50, and 52, respectively, moving back and forth in reciprocating fashion along a rotational axis of cylindrical assembly 14. Each movable member 46 through 52 moves in response to isothermal or adiabatic expansion or compression of the working substance as the working substance circulates between heat pump 42 and cold sink 12 and between cold sink 12 and heat pump 42. Each piston pump 38 through 44 has first and second one way valves 54 and 56 that allow the working substance to enter through first one way valve 54 and be expelled though second one way valve 56.

Referring to FIG. 5, there is a first supplementary heat exchanger 58 for effecting a heat exchange between a source of heat in an external environment and the first and third transfer paths 24, 25 and a second supplementary heat exchanger 60 for effecting a heat exchange between a source of cold in the external environment and the second and fourth transfer paths 26, 27. First and second supplementary heat exchangers 58 and 60 have specified volumes or other controls such that, as new working substance is input into the heat exchangers 58 and 60 or as the working substance expands in first supplementary heat exchanger 58, the heated or cooled working substance is expelled. The temperature of each heat exchanger 58 and 60 is higher or lower relative to the temperature of the working substance being input into it. In one example, if the working substance is the same as the substance in the atmosphere (such as air if used outside), heat exchanger 58 or 60 may be the atmosphere, such that warmer or colder air is vented from the engine, and colder or warmer air is drawn into the engine. In addition, heat exchangers 58 and 60, or venting, may be included at different locations than those depicted in the drawings. For example, heat exchanger 60 may be connected to receive a working fluid as it is expelled from piston pump 48 on either compression cycle (not shown) prior to being moved to the next element.

Figure 10:
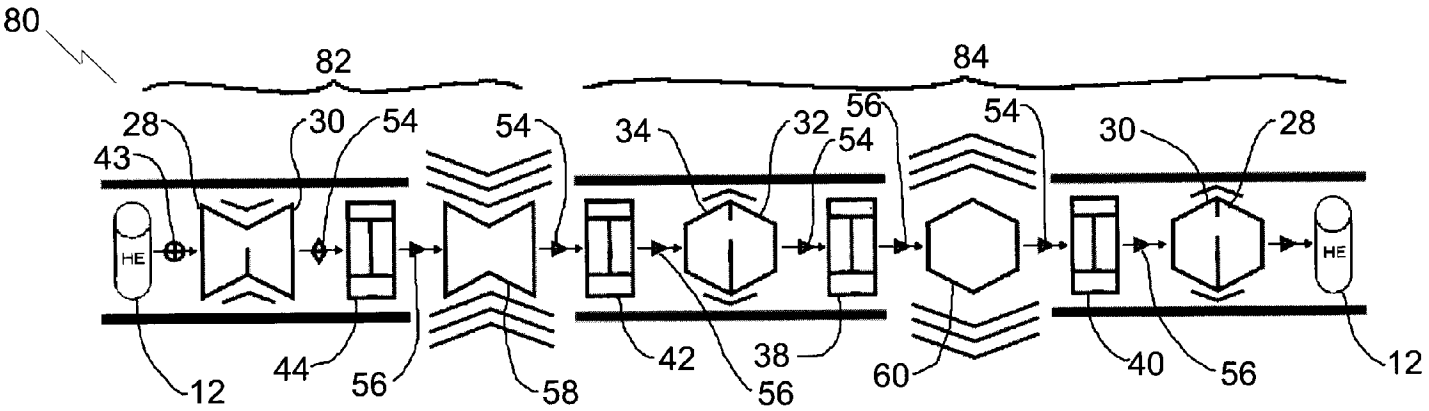
FIG. 10 is the flow chart of FIG. 5 depicting paths based on pressure.
Figure 11:
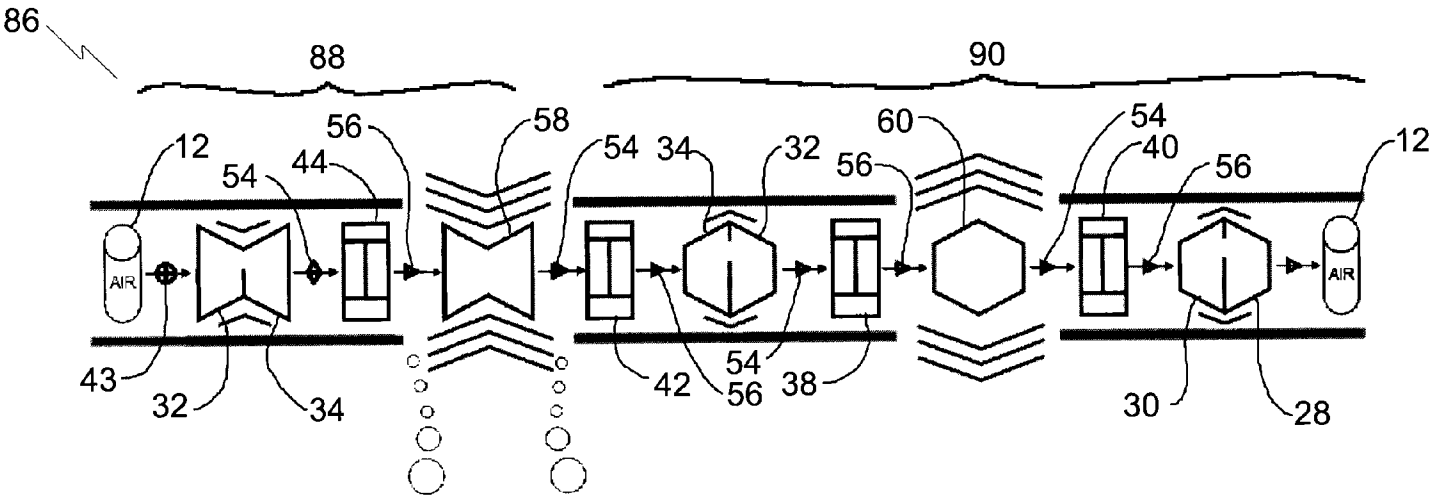
FIG. 11 is the flow chart of FIG. 6 depicting paths based on pressure.

Another way of looking at engine 10 is to consider expansion and compression paths going from the working substance being at its most compressed point to the working substance being at its most expanded point. This is shown in FIGS. 10 and 11. The components are the same as those described above, however, the expansion and compression paths end at different points, and have thus been given different reference numbers.

Accordingly, there is a first working substance cycle 80 having a first expansion path 82 and a first compression cycle 84. First working substance cycle 80 is in communication with a first cold source (cold sink) 12 of a first working substance. There is a second working substance cycle 86 having a second expansion cycle 88 and a second compression cycle 90. Second working substance cycle 86 is in communication with a second cold source of a second working substance, which may be a partitioned section of cold sink 12, or it may be a separate source. Each working substance expands upon the application of heat, and contracts upon the removal of heat. First supplementary heat exchanger 58 expands the working substances in first and second expansion paths 82 and 88 by the addition of heat. Second supplementary heat exchanger 60 compresses the working substances in first and second compression paths 84 and 90 by removing heat.

Figure 4:
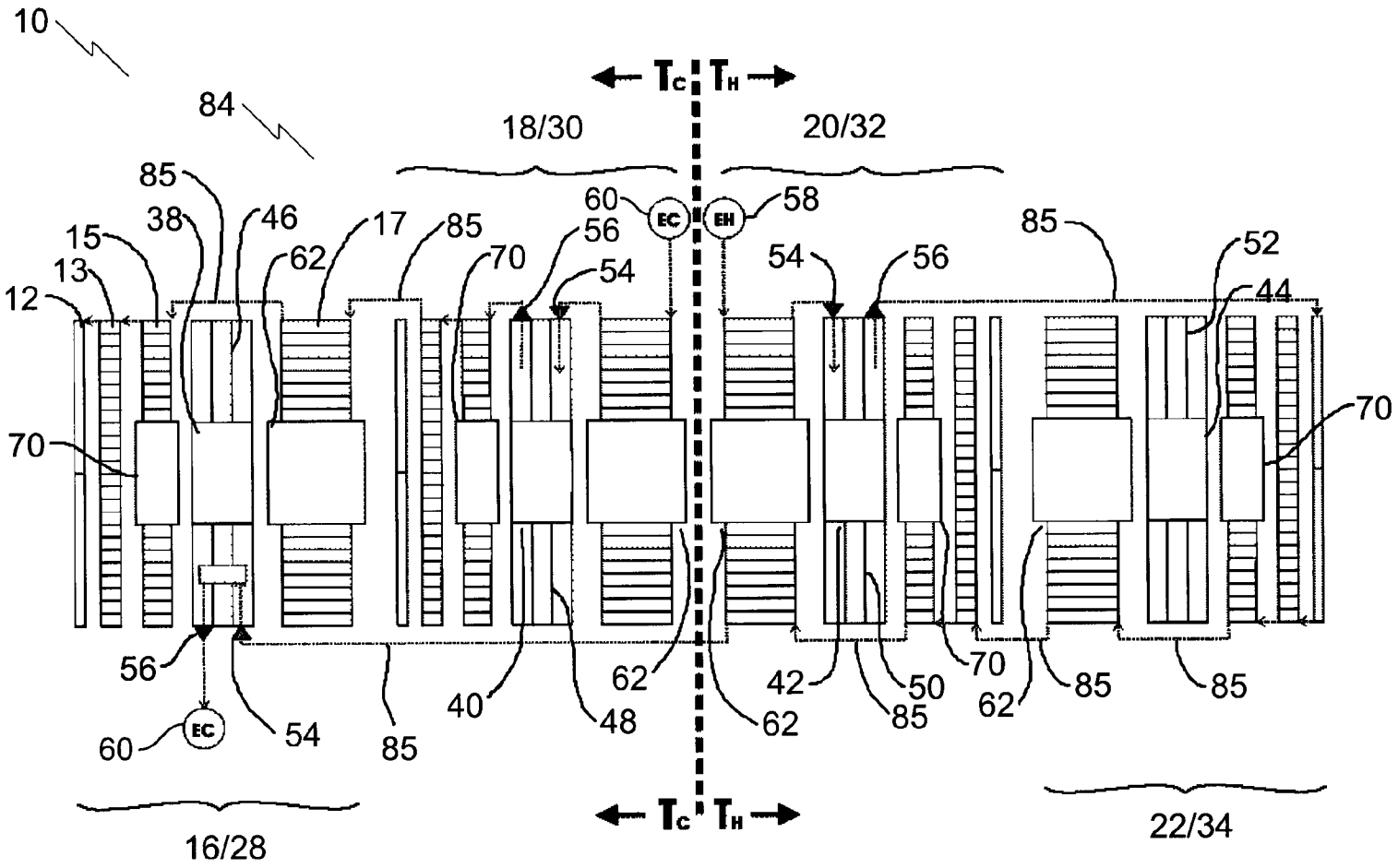
FIG. 4 is an exploded schematic view of the carnot engine, with the components rotated 90°, and depicting the first compression flow path.

In first expansion path 82, the first working substance is released from cold source 12, and absorbs heat in each of the first heat exchanger 28, the second heat exchanger 30, and the fourth piston pump 44. The expanding first working substance in fourth piston pump 44 causes fourth piston pump 44 to move in a first direction, while the movement of fourth piston pump 44 in a second direction expels the heated first working substance from fourth piston pump 44 into first supplementary heat exchanger 58. Referring to FIG. 3, first expansion path 82 is depicted by arrows 83. Referring to FIG. 4, first compression path 84 is depicted by arrows 85. Similar paths may be drawn for the other working fluid paths depicted in FIGS. 5, 6 and 11.

In first compression path 84, the first working substance is received from first supplementary heat exchanger 58 by third piston pump 42. The movement of third piston pump 42 in a first direction compresses the first working substance such that the temperature is raised. The compressed first working substance sequentially deposits heat into fourth heat exchanger 34, third heat exchanger 32, first piston pump 38, second supplementary heat exchanger 60, second piston pump 40 and first heat exchanger 28 prior to being returned to cold source 12. The cooling working substance in first piston pump 38 causes first piston pump 38 to move in a first direction as the working substance contracts. The cooling working substance is compressed by movement of second piston pump 40 in a first direction prior to depositing heat in first heat exchanger 38 as it is returned to cold source 12.

In second expansion path 88, the second working substance is released from cold source 12, and absorbs heat sequentially in each of third heat exchanger 32, fourth heat exchanger 34, and fourth piston pump 44, such that the expanding second working substance in fourth piston pump 44 causes fourth piston pump 44 to move in the second direction. The movement of fourth piston pump 44 in the first direction after movement in the second direction expels the heated second working substance from fourth piston pump 44 into first supplementary heat exchanger 58.

In the second compression path 90, the second working substance is received from first supplemental heat exchanger 58 into third piston pump 42. The movement of third piston pump 42 in a second direction compresses the second working substance such that the temperature is raised. The compressed second working substance is expelled from third piston pump 42 and deposits heat sequentially in fourth heat exchanger 34, third heat exchanger 32, first piston pump 38, second supplemental heat exchanger 60, second piston pump 40 and first heat exchanger 28. The cooling working substance in first piston pump 38 causes first piston pump 38 to move in a second direction as the working substance contracts. The cooling working substance is compressed by movement of second piston pump 40 in a second direction prior to depositing heat in first heat exchanger 28 and being returned to cold source 12.

Figure 7:
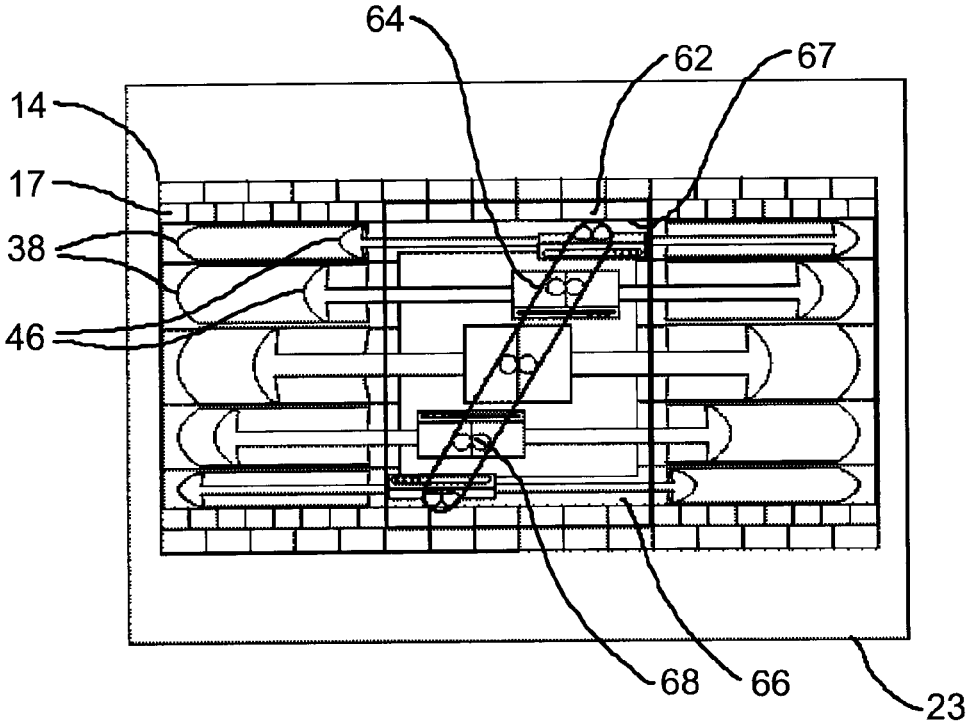
FIG. 7 is a partially transparent side view in section of a piston and crank sleeve.
Figure 8:
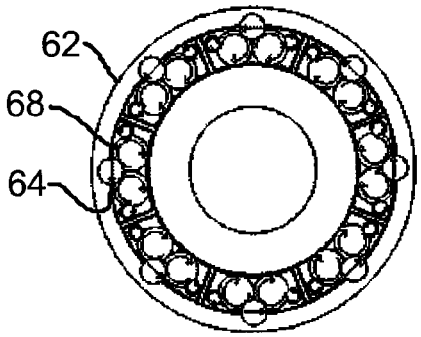
FIG. 8 is a end view in section of the bearing assembly.

Referring to FIG. 7, work may be removed from engine 10 by providing a crank sleeve 62 that overlies movable members 46, 48, 50, 52 (only 46 is shown) with a mechanical connection to each movable member 46, 48, 50, 52 to convert the reciprocating movement of movable members 46, 48, 50, 52 into rotational movement of crank sleeve 62. Referring to FIG. 7, the mechanical connection may be a guide track engagement 64 on an exterior surface 66 of each movable member 46, 48, 50, 52 and on an interior surface 67 of crank sleeve 62 that guides bearings 68. As shown, movable member 46 may be made up of a series of double-acting pistons, such that the flow of the working substances into and out of piston pumps 38, 40, 42, 44 is more continuous. As double-acting pistons 46 reciprocate, bearings 68, which are attached to pistons 46, move within guide track engagement 64, thus converting the reciprocating movement of piston 46 to rotational movement of crank sleeve 62. Referring to FIG. 2, a series of flywheels 70 may be incorporated into each section 16, 18, 20, 22 (only 16 is shown) of the cylindrical assembly to increase the inertial forces maintaining rotation of the cylindrical assembly.

As engine 10 is used to produce mechanical power, it is necessary to lubricate the engine as well. Because of the wide range of temperatures that may be encountered, it may be necessary to use different lubricants in different sections. If a lubrication cycle is used, the lubricants could also be heated and cooled using the engine or the unlimited heat/cold sources.

Operation:

A method of externally modifying a Carnot engine cycle will now be described with reference to FIG. 1 through 11. As described above, a heat exchange path is provided between the external environment and a working substance circulating in carnot engine 10. This permits carnot engine 10 to draw from an endless supply of heat or cold, or an endless heat source or heat sink, in the external environment to regenerate the Carnot engine cycle as entropic losses are encountered and as differential heat energy is converted into power. Ideally, the endless supply of heat or cold is at a lower temperature than the highest temperatures achieved by the heat pumps within engine 10, such that the endless heat source and/or heat sink acts to add or remove thermal energy at intermediate points along the various transfer paths. To achieve this, carnot engine 10 is positioned in external environments (which may, in some cases, be the same environment) that is able to provide what amounts to an unlimited source of heat or an unlimited source of cold. Heat exchange path are then provided between the external environments the necessary components of carnot engine 10, such that the carnot engine is able to draw from an endless supply of heat or cold to regenerate the Carnot cycle as entropic losses are encountered and as differential heat energy is converted into power.

One embodiment of how this may be done is shown in the drawings, and is described in the example below.

Example

In this example, two working fluids are used: helium and air. The path that the working fluids take will be described from cold source 12 to heat source 42, however it will be understood that the process is a continuous process, and could equally be described from various points in the transfer paths 24 and 26. The first transfer path 24, which circulates the helium from the cold source 12 to the heat source 42 begins with helium being released through a regulator valve 43, such as a revolving door valve, from a source of cold, pressurized liquid helium 12. The helium is permitted to expand as a gas through both sets of exchange tubes in first and second sections 16 and 18. The helium then passes through a one-way valve into the pump in fourth section 22 where it is heated by the warm gas present in exchange tubes in fourth section 22. This heating causes the helium gas to expand, and push against movable member 52 in piston pump 44. Once the helium gas has been expanded, the gas is released to a heat source, which may be an external heat source such as a solar panel, etc. The helium gas in the heat source is heated in an isobaric and isometric environment, such that as the gas is heated, it is expelled through the outer set of exchange tubes in third section 20 and into third piston pump 42. The helium gas is compressed in third piston pump 42, which results in the temperature being raised, and is then expelled into the central component of fourth section 22. The heated helium gas is then passed into the second transfer path 26 toward cold source 12.

Heated helium gas flows from heat source 42 through the exchange tubes in both third and fourth sections 20 and 22, imparting heat to the working substances at different stages of the paths in these sections, and into piston pump 38 in first section 16. The helium gas is drawn into piston pump 38 as it moves up due to another working gas being cooled and compressed on the other side of piston pump. As helium gas remains in the pump, it also contracts, and pulls the piston pump back. The cooled helium gas is then expelled to a external cold source, or external heat sink, as the piston continues to move due to the momentum in the flywheel. The term external refers to the cold source being outside the sections of the carnot engine. The temperature of the external cold source is at a temperature below the temperature of the compressed helium gas being expelled from piston pump 38. After depositing heat to the external cold source, the helium gas then travels from the external cold source into the outer exchange tubes of second section 18, and is drawn into piston pump 40 in second section 18, where it is compressed, and expelled into the inner exchange tubes of second section 18. Alternatively, a feedback loop may be established to the external cold source at this point, such that a portion of the compressed helium gas is returned in order to remove additional heat from the helium gas. From the inner tubes of second section 18, it is drawn through the exchange tubes of first section 16 where it is cooled by the liquid helium and liquid air being released into first and second sections 16 and 18, and ultimately liquefied and returned to cold source 12.

The cycle of the second working fluid will also be described beginning with a cold, pressurized source of liquid air, which is adjacent to the source of liquid helium. Liquid air is released through a throttle valve 43 into the exchange tubes of third and fourth sections 20 and 22, where it passes progressively from the outer exchange tube of third section 20 to inner exchange tube of fourth section 22. Throughout these sections, it is heated by the warmer working fluids also present in these sections. From the inner exchange tube of the fourth section 22 the warmed air is injected into the fourth piston pump 44 where it is heated and expanded even further, which causes piston pump 44 to move. The expanding air on one side of fourth piston pump 44 causes movement in one direction, while the expanding helium in the previously described cycle on the other side of piston pump 44 causes movement in the other direction. After expansion, the air is exhausted to atmosphere, or to third pump 42, or a combination of these two options. If the air is exhausted to atmosphere, air from atmosphere is drawn into third pump 42. Venting air to atmosphere and drawing in replacement air may be used as a strategy to increase the amount of energy in the carnot engine 10, if the air being released from fourth pump 44 is cooler than the air being drawn into third pump 42.

In third pump 42, the air is compressed by the movement of the piston, which heats the air. The heated air is then passed through a valve to the inner exchange tube of fourth section 22. The heated air flows progressively through sections 22 and 20, from inner exchange tubes to outer exchange tubes in each. During this process, the air loses heat to the working substances in other exchange tubes. The air is then drawn into first piston pump 38, where it is compressed by the cold working substances in the exchange tubes around it absorbing heat. As air compresses, it contracts and pulls the piston pump back. The compressed air is released from first piston pump 38 into an external cold source where more heat is removed. The cold air is expelled from the external cold source into the outer exchange tubes of second section 18, then into second piston pump 40 where it is compressed to increase its pressure. The compressed air is then passed through the inner exchange tubes of second section 18, and through first section 16 from the outer exchange tubes to the inner exchange tubes, where sufficient heat is removed such that the air is liquefied. Optionally, the compressed air exiting second piston pump 40 may be re-circulated to an external cold source to remove additional heat before passing through the inner exchange tubes of second section 18.

Structure and Relationship of Parts of a Second Embodiment:

In the embodiment described below, the four stages of the thermodynamic cycle, namely, adiabatic expansion, isothermal expansion, adiabatic compression and isothermal compression, are completed in a different configuration of engine 10. In the description that follows similar reference numerals are used to indicate similar components, although they may be in a different location.

Figure 12:
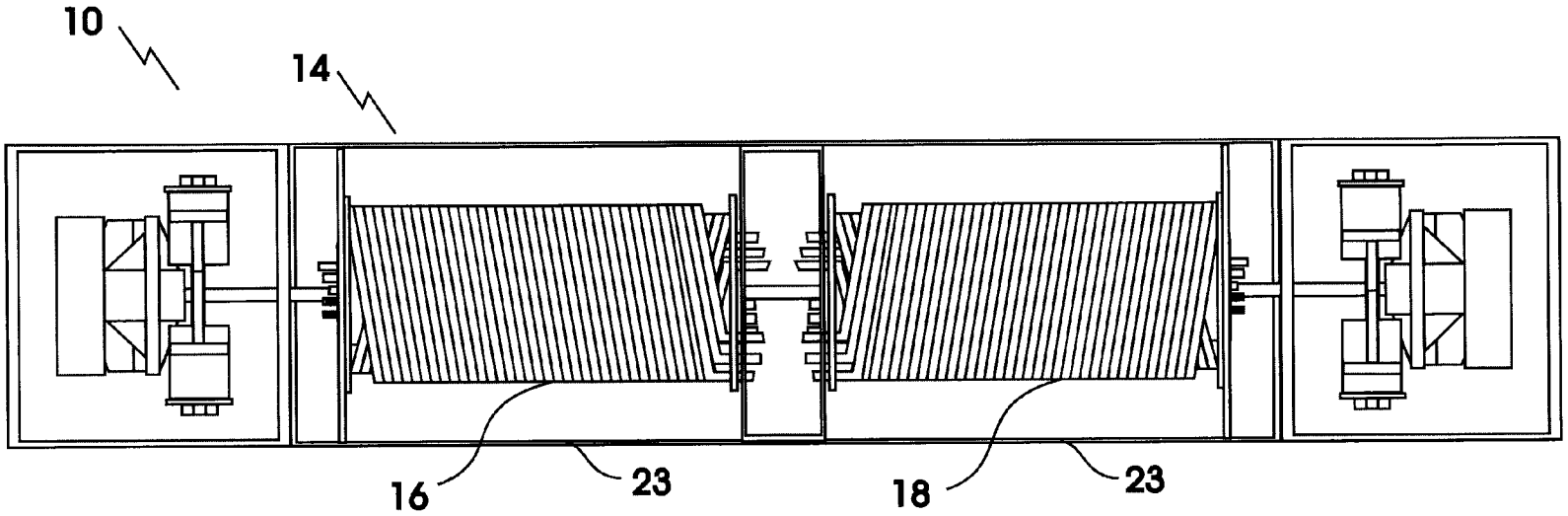
FIG. 12 is a side view in partial section of a carnot engine.
Figure 13:
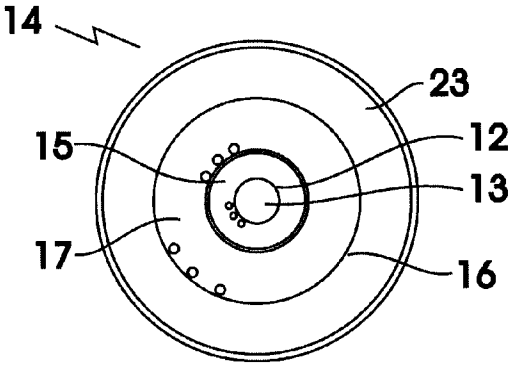
FIG. 13 is an end view in section of a cylindrical assembly of the carnot engine illustrated in FIG. 12.
Figure 14:
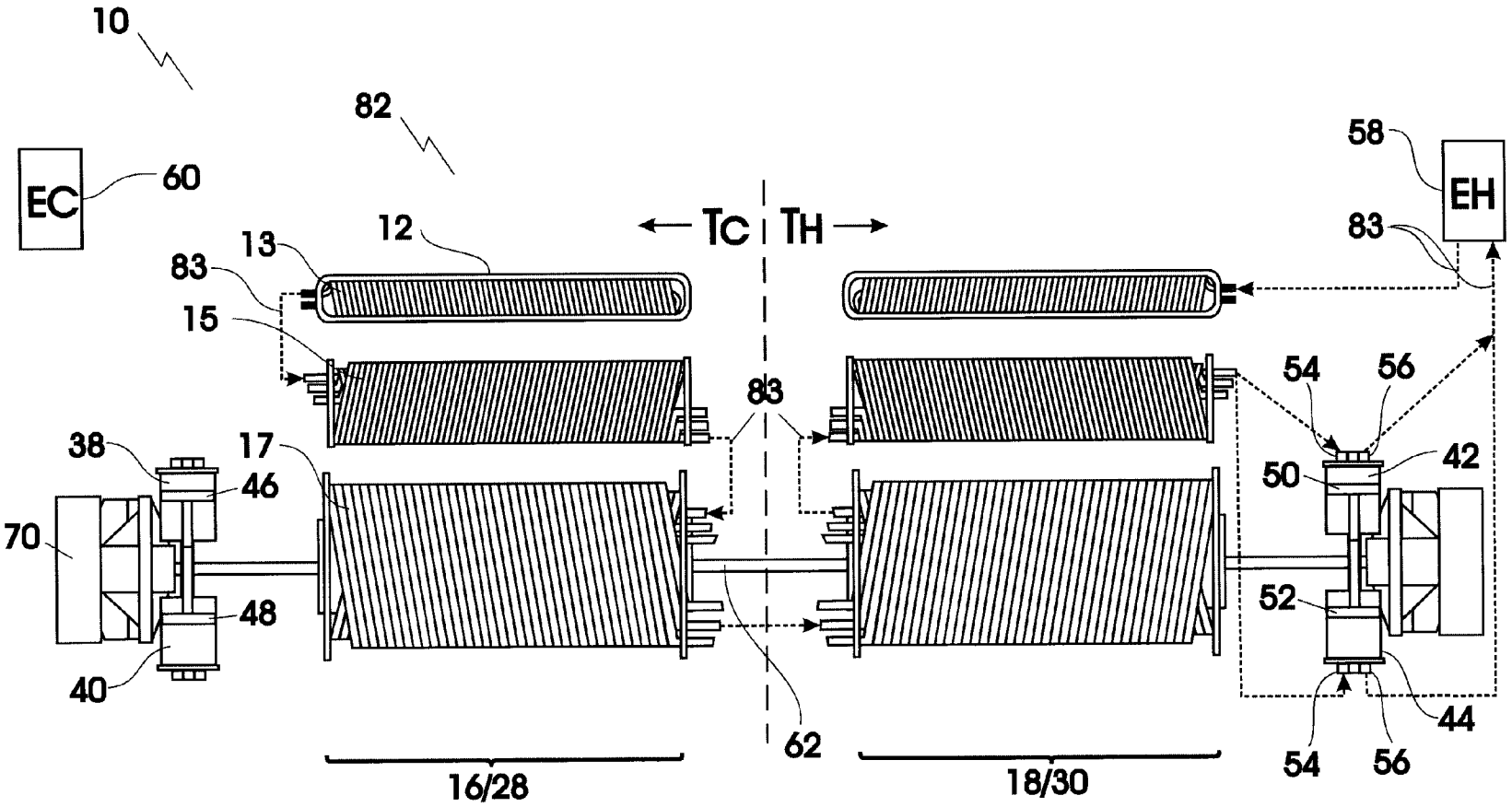
FIG. 14 is an exploded schematic view of the carnot engine components, and depicting the first expansion flow path.

Referring to FIG. 14, carnot engine 10 has a cold source 12 in the form of a container holding a working substance. In the depicted embodiment, the working substance is a gas that expands when heated, and compresses when cooled. In carnot engine 10, the working substance will undergo isobaric or isometric heating or cooling, and isothermal or adiabatic expansion or contraction, depending on the stage. Cold source 12 is a container holding the working substance. Referring to FIG. 12, there is a cylindrical assembly 14 made up of a series of axially spaced sections, namely a first section 16, a second section 18. Each section is in an individually insulated compartment 23, and, referring to HG. 14 and 15, each section is formed of a series of concentric nested components. The main nested components include inner exchange tubes 13 and 15, outer exchange tubes 17, and the components to remove work from engine 10, namely piston pump 38, 40, 42 or 44, a flywheel 70. Cold source 12 may be positioned at the centre of first section 16. Generally, as shown in FIG. 14, the temperature of engine 10 increases from the left to the right with the central component of each section having the most extreme temperature, either hot or cold. The components in FIG. 14 are shown in an exploded view for clarity in the drawing.

Figure 15:
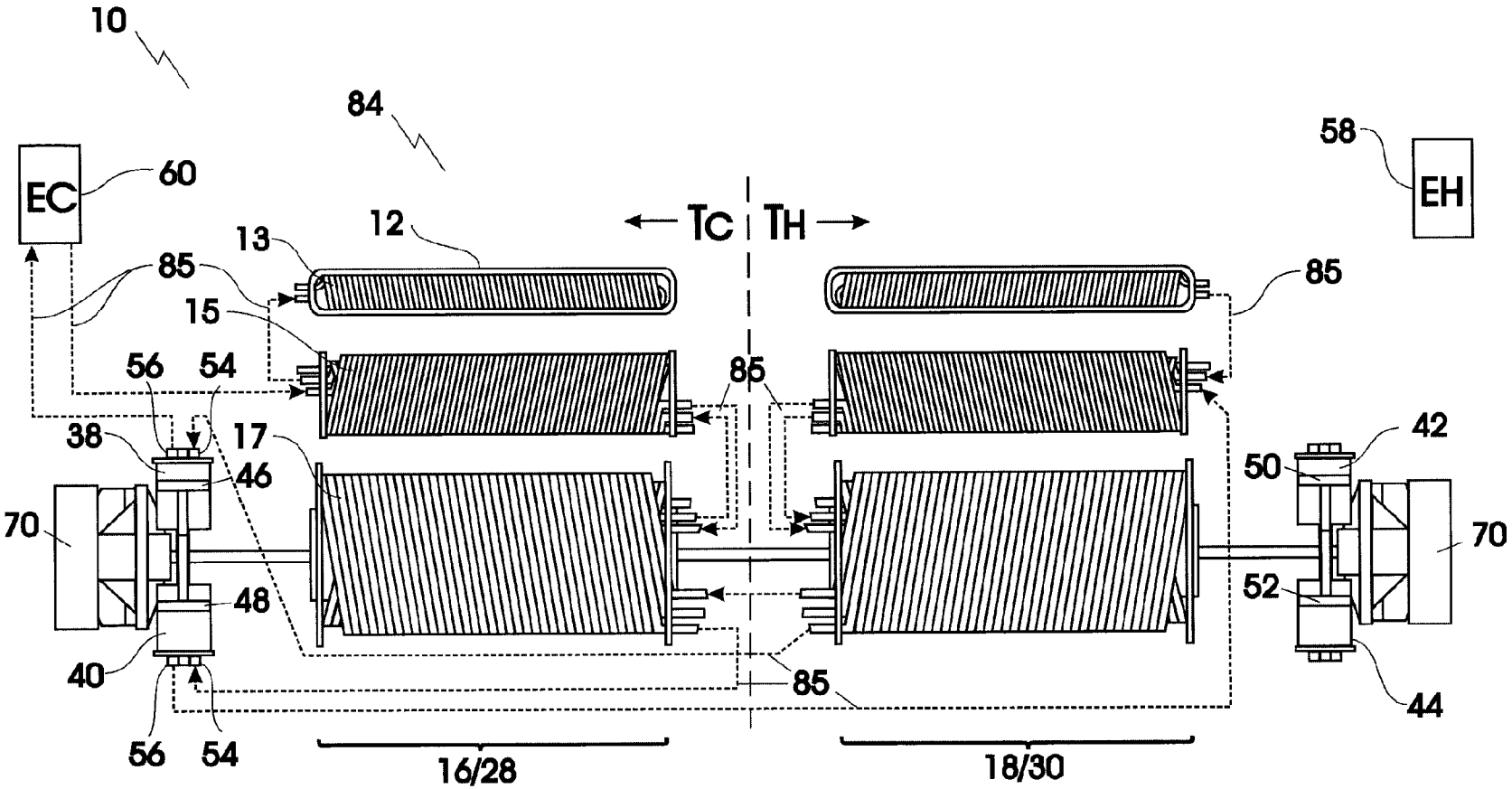
FIG. 15 is an exploded schematic view of the carnot engine components, and depicting the first compression flow path.
Figure 16:
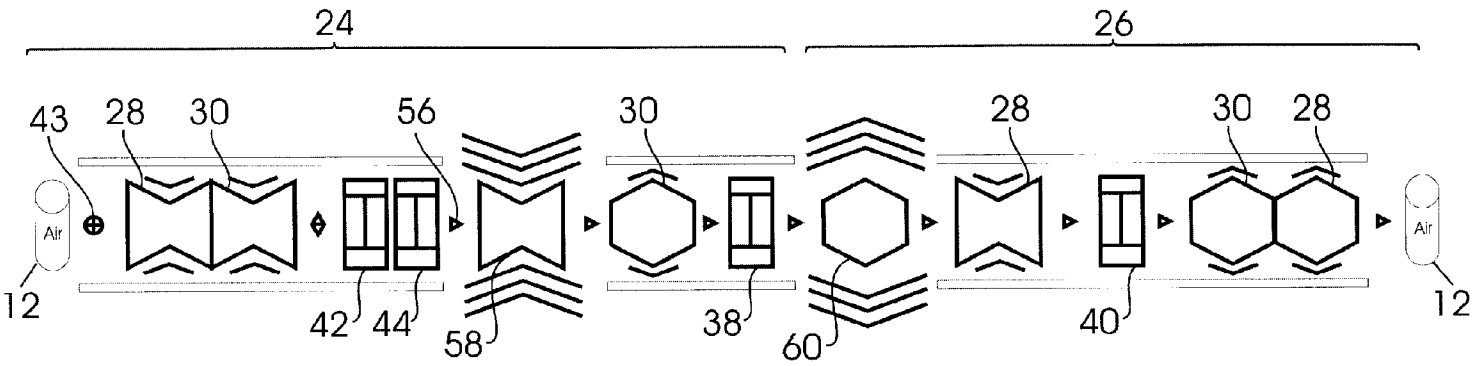
FIG. 16 is a flow chart of the cycle of a working substance depicting paths based on heat.

Referring to FIG. 16, cylindrical assembly 14 is made up of two heat transfer paths. FIG. 16 is a flow chart that represent the progression of a working substance through engine 10. The relative position of each component is shown in FIG. 12 through 15. A first transfer path 24 circulates a working substance through the series of axially spaced sections 16, 18 from cold sink 12 to a piston pump 38. A second transfer path 26 circulates the working substance through the series of axially spaced sections 16, 18 from pump 38 to cold source 12.

There is also a series of primary heat exchangers, including a first primary heat exchanger 28, a second primary heat exchanger 30 made up of exchange tubes 13, 15, 17. Heat exchangers 28, 30 correspond to sections 16, 18 and effect a heat exchange between transfer paths 24, 26 to perpetuate the Carnot cycle by cooling in sequential stages the working substance flowing from pump 38 to cold sink 12, and heating in sequential stages the working substance flowing from cold sink 12 to heat pump 38. The actual heat exchanges that occur in the preferred embodiment are described in the example given below. It will be understood that, using the principles discussed herein, the actual cooling or heating path may include some intermediate steps that result in the working substance being heated as it flows from pump 38 to cold sink 12, or cooled as it flows from cold sink 12 to pump 38, so long as the overall cooling or heating trend along each respective path is maintained in the proper direction.

In the example shown and described below, each heat exchanger 28, 30 have three sub-paths. Referring to FIG. 9, the three sub-paths 35, 36, 37 are shown as alternating as they are wound together throughout inner exchange tube 15. The various sub-paths 35, 36, 37 within exchange tube 15 have been textured with different textures to indicate which sub-paths are connected. A similar winding may be found in each exchange tube 17. The actual design used to provide sub-paths 35, 36, 37 may be varied, and FIG. 9 is merely representative of one implementation. Each transfer path 24, 26, is made up of one of the sub-paths 35, 36, 37 in each heat exchanger 28, 30 to allow the working substances to remain physically separate while permitting thermal energy transfer to occur. Generally, the first and second sub-paths 35, 36 are used for sections where either the first or second working substance passes in both directions through that particular section, depending on the transfer path, while the third sub-path 37 is used for the other working substance, which only passes in one direction through that section. It will be understood that the actual number and position of flow paths may be modified, depending on the final implementation of engine 10.

Referring to FIGS. 14 and 15, there are also a series of piston pumps 38, 40, 42 and 44 that have movable members 46, 48, 50, and 52, respectively. Each movable member 46 through 52 moves in response to isothermal or adiabatic expansion or compression of the working substance as the working substance circulates between pump 38 and cold sink 12 and between cold sink 12 and pump 38. Each piston pump 38 through 44 has first and second one way valves 54 and 56 that allow the working substance to enter through first one way valve 54 and be expelled though second one way valve 56.

There is a first supplementary heat exchanger 58 for effecting a heat exchange between a source of heat in an external environment and the first transfer paths 24, and a second supplementary heat exchanger 60 for effecting a heat exchange between a source of cold in the external environment and the second transfer path 26. First and second supplementary heat exchangers 58 and 60 have specified volumes or other controls such that, as new working substance is input into the heat exchangers 58 and 60 or as the working substance expands in first supplementary heat exchanger 58, the heated or cooled working substance is expelled. The temperature of each heat exchanger 58 and 60 is higher or lower relative to the temperature of the working substance being input into it. In one example, if the working substance is the same as the substance in the atmosphere (such as air if used outside), heat exchanger 58 or 60 may be the atmosphere, such that warmer or colder air is vented from the engine, and colder or warmer air is drawn into the engine. In addition, heat exchangers 58 and 60, or venting, may be included at different locations than those depicted in the drawings.

Figure 17:
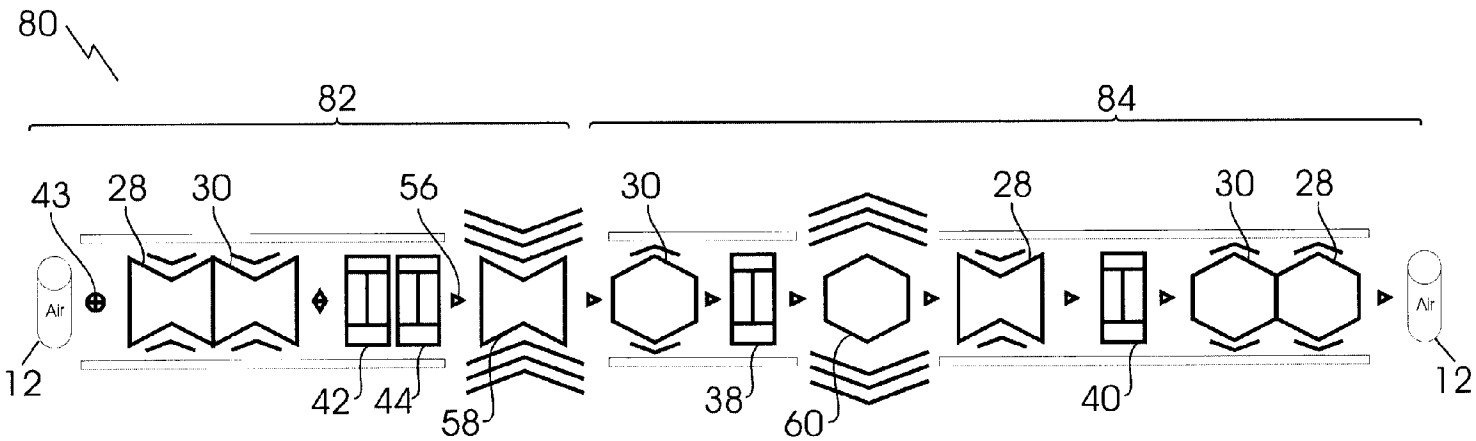
FIG. 17 is the flow chart of FIG. 16 depicting paths based on pressure.

Another way of looking at engine 10 is to consider expansion and compression paths going from the working substance being at its most compressed point to the working substance being at its most expanded point. This is shown in FIG. 17. The components are the same as those described above, however, the expansion and compression paths end at different points, and have thus been given different reference numbers.

Accordingly, there is a working substance cycle 80 having an expansion path 82 and a compression cycle 84. Working substance cycle 80 is in communication with a cold source (cold sink) 12 of a working substance. Working substance expands upon the application of heat, and contracts upon the removal of heat. First supplementary heat exchanger 58 expands the working substances in expansion path 82 by the addition of heat. Second supplementary heat exchanger 60 compresses the working substances in compression path 84 by removing heat.

In expansion path 82, the working substance is released from cold source 12, and absorbs heat in each of the first heat exchanger 28, the second heat exchanger 30, and the third and fourth piston pump 42 and 44. The expanding working substance causes third and fourth piston pumps 42 and 44 to move in a first direction, while the movement of third and fourth piston pump 42 and 44 in a second direction expels the heated working substance into first supplementary heat exchanger 58. Referring to FIG. 14, expansion path 82 is depicted by arrows 83. Referring to FIG. 15, compression path 84 is depicted by arrows 85.

In compression path 84, the working substance is received from first supplementary heat exchanger 58 by first piston pump 38. The movement of first piston pump 38 in a first direction draws the working substance through the second heat exchanger 30 and into piston pump 38. The second movement of first piston pump 38 compresses working substance into second supplementary heat exchanger 60 where working substance deposits heat. Working substance moves from supplementary heat exchanger 60 through first heat exchanger 28 absorbing additional heat. Working substance is then received into second piston pump 40 whereby the first movement of piston pump 40 draws working substance into pump 40, while the second movement of pump 40 compresses working substance into second heat exchanger 30 and first heat exchanger 28 where it deposits heat as it is returned to cold source 12.

Referring to FIG. 14, work may be removed from engine 10 by providing an axle 62 that communicates movement between members 46, 48, 50, 52 to convert the movement of movable members 46, 48, 50, 52 into rotational movement of axle 62. As shown, movable members 46,48,50,52 may be made up of a series of pistons.

Operation:

A method of externally modifying a Carnot engine cycle will now be described with reference to FIG. 12 through 17. As described above, a heat exchange path is provided between the external environment and a working substance circulating in carnot engine 10. This permits carnot engine 10 to draw from an endless supply of heat or cold, or an endless heat source or heat sink, in the external environment to regenerate the Carnot engine cycle as entropic losses are encountered and as differential heat energy is converted into power. Ideally, the endless supply of heat or cold is at a lower or higher temperature than the highest temperatures achieved by the heat pumps within engine 10, such that the endless heat source and/or heat sink acts to add or remove thermal energy at intermediate points along the various transfer paths. To achieve this, carnot engine 10 is positioned in external environments (which may, in some cases, be the same environment) that is able to provide what amounts to an unlimited source of heat or an unlimited source of cold. Heat exchange path are then provided between the external environments the necessary components of carnot engine 10, such that the carnot engine is able to draw from an endless supply of heat or cold to regenerate the Carnot cycle as entropic losses are encountered and as differential heat energy is converted into power.

One embodiment of how this may be done is shown in the drawings, and is described in the example below.

Example

In this example, a single elastic working substance, such as air, is used. The path that the working substance takes will be described from cold source 12 to heat source 58, however it will be understood that the process is a continuous process, and could equally be described from various points in the transfer paths 82 and 84. Transfer path 82, which circulates the gas from the cold source 12 to the heat source 58 begins with compressed gas being released through a regulator valve 43, such as a revolving door valve, from a source of cold 12. The gas is permitted to expand through both sets of exchange tubes in first and second sections 16 and 18 along first transfer path 82, drawing heat as it communicates with other transfer path containing working substance at higher temperatures and varying stages of the cycle. The expanding gas then passes into third and fourth piston pumps where it will push against movable members 50 and 52 in piston pumps 42 and 44. Once the gas has expanded, the gas is released to a heat source, which may be an external heat source such as a solar panel, etc. The gas in the heat source is heated in an isobaric and isometric environment, such that as the gas is heated, it is expelled through the exchange tubes in section 18 and into first piston pump 38. The gas is compressed in first piston pump 38. After depositing heat to the external cold source, the gas then travels from the external cold source into the exchange tubes of second section 16 where it absorbs heat.

The gas is then drawn into piston pump 40 where it is further compressed, and expelled into the inner exchange tubes of second 18 to deposit additional heat. Alternatively, a feedback loop may be established to the external cold source at this point, such that a portion of the compressed gas is returned in order to remove additional heat from the gas. From the exchange tubes of second section 18, it is drawn through the exchange tubes of first section 16 where it is cooled and compressed by the expanding gas being released into first section 16, and ultimately returned to cold source 12.

Variations:

The mechanical models which have been set forth above are merely intended to demonstrate various ways of implementing the teachings of the method of externally modifying a Carnot engine cycle. It will be appreciated by one skilled in the art that carnot engines in different configurations could benefit by being modified in accordance with the teachings of the above described methods. An environment in which there is an unlimited source of heat is a desert. It will be appreciated that even more temperate climates may provide an unlimited source of heat during the summer months. An environment in which there is an unlimited source of cold is a polar environment. It will be appreciated that even more temperate climates may provide an unlimited source of cold during the winter months. An environment where there is an unlimited source of heat and an unlimited source of cold present at the same time is space, with the heat being collected as solar energy.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A method of externally modifying a Carnot engine cycle, the method comprising the steps of:

providing a Carnot engine comprising:

a heat source;

a cold source; comprising a container holding a cryogenic working substance in liquid form;

a first transfer path for circulation of the cryogenic working substance from the heat source to the cold source, the cryogenic working substance existing in a gas form at the heat source, such that the cryogenic working substances goes from a liquid phase to a gas phase with resulting isothermal and adiabatic expansion;

a second transfer path for circulation of the cryogenic working substance from the cold source to the heat source, the cryogenic working substance going from a gas phase at the heat source to a liquid phase at the cold source resulting in isothermal and adiabatic compression;

means for converting differential heat energy into power as the working substance circulates between the heat source and the cold source;

means for effecting a heat exchange between the first transfer path and the second transfer path to perpetuate the Carnot cycle by cooling the cryogenic working substance flowing from the heat source to the cold source and heating the cryogenic working substance flowing from the cold source to the heat source;

means for effecting a heat exchange between an external environment and at least one of the first transfer path or the second transfer path;

positioning the Carnot engine in an external environment providing at least one of an unlimited source of heat or an unlimited source of cold;

providing a heat exchange path between the external environment and at least one of the first transfer path or the second transfer path of the Carnot engine, such that the Carnot engine is able to draw from an endless supply of heat or cold to regenerate the Carnot cycle as entropic losses are encountered and as differential heat energy is converted into power.

2. The method according to claim 1, further comprising the step of the means for converting differential heat energy into power including a series of movable members that are responsive to the isothermal or adiabatic expansion and compression of the working substance.

3. The method according to claim 2, further comprising the step of the heat source being a heat pump containing one of the series of movable members.

4. The method according to claim 1, further comprising the step of the means for effecting a heat exchange between the first transfer path and the second transfer path to perpetuate the Carnot cycle being a series of primary heat exchangers, each primary heat exchanger having a first flow path which forms part of the first transfer path and a second flow path which forms part of the second transfer path.

5. The method according to claim 1, further comprising the step of the means for effecting a heat exchange between an external environment and at least one of the first transfer path or the second transfer path being at least one supplementary heat exchanger having a first flow path which forms part of one of the first transfer path or the second transfer path and a second flow path which communicates with the external environment.

6. A method of externally modifying a Carnot engine cycle, the method comprising the steps of:

providing a Carnot engine comprising:

a cold source in the form of a container holding a working substance, the working substance being a cryogenic working substance which, when heated, goes from a liquid phase to a gas phase with resulting isothermal and adiabatic expansion and, when cooled, goes from a gas phase to a liquid phase resulting in isothermal and adiabatic compression, and the cold source is a container holding the working substance in liquid form;

a heat source in the form of a heat pump that produces the highest internal temperature within the Carnot engine;

a first transfer path for circulation of the working substance from the cold source to the heat source;

a second transfer path for circulation of the working substance from the heat source to the cold source;

a series of primary heat exchangers, including a first primary heat exchanger, a second primary heat exchanger, and a third primary heat exchanger for effecting a heat exchange between the first transfer path and the second transfer path to perpetuate the Carnot cycle by cooling in sequential stages the working substance flowing from the heat source to the cold source, and heating in sequential stages the working substance flowing from the cold source to the heat source, each heat exchanger having a first flow path which forms part of the first transfer path and a second flow path which forms part of the second transfer path;

a series of movable members including a first movable member, a second movable member, a third movable member and a fourth movable member, that move in response to the expansion or compression of the working substance as the working substance circulates between the heat source and the cold source and between the cold source and the heat source;

a first supplementary heat exchanger for effecting a heat exchange between a source of heat in an external environment and the first transfer path;

a second supplementary heat exchanger for effecting a heat exchange between a source of cold in the external environment and the second transfer path; and means for converting movement of the series of movable members into useful work;

passing the working substance from the cold source through at least the first primary heat exchanger to add sufficient heat to expand the working substance;

directing the working substance exiting the first primary heat exchanger to the fourth movable member such that expansion of the working substance causes movement of the fourth movable member;

passing the working substance from the fourth movable member through the first supplementary heat exchanger to add additional heat to the working substance through a heat exchange with the source of heat in the external environment;

directing the working substance exiting the first supplementary heat exchanger to the third movable member, which is positioned in the heat pump serving as the heat source, the movement of the third movable member causing the compression of the working substance;

passing the working substance through at least the third primary heat exchanger to remove heat from the working substance;

directing the working substance exiting the third primary heat exchanger to the first movable member, the heat of the working substance being removed such that the working substance compresses, causing movement of the first movable member;

passing the working substance from the first movable member through the second supplementary heat exchanger to remove additional heat from the working substance through a heat exchange with a source of cold in the external environment;

directing the working substance exiting the second supplementary heat exchanger to the second movable member, the second movable member compressing the working substance;

passing the working substance from the second movable member through the second primary heat exchanger and the first primary heat exchanger to remove sufficient heat to liquefy the working substance;

returning the working substance exiting the first primary heat exchanger to the cold source.

7. The method according to claim 6, further comprising the step of providing a cylindrical assembly of concentric nested components with the series of movable members moving back and forth in reciprocating fashion along a rotational axis of the cylindrical assembly, and the means for converting movement of the series of movable members into useful work being an overlying crank sleeve, an engagement being provided on an exterior surface of each movable member and provided on an interior surface of the crank sleeve to convert the reciprocating movement of series of movable members into rotational movement of the crank sleeve.

8. The method according to claim 6, further comprising a third transfer path distinct from the first transfer path for circulation of the working substance from the cold source to the heat source, and a fourth transfer path distinct from the second transfer path for circulation of the working substance from the heat source to the cold source.

9. The method according to claim 8, further comprising the step of the working fluid in the first transfer path and the second transfer path being a first working fluid, and the working fluid in the third transfer path and the fourth transfer path being a second working fluid.

10. The method according to claim 8, further comprising the step of the third transfer path and the fourth transfer path comprising the following steps:

passing the working substance from the cold source to at least the third heat exchanger to add sufficient heat to expand the working substance;

directing the working substance exiting the third heat exchanger to the fourth movable member which is positioned in the heat pump serving as the heat source, with the expansion of the working substance causing movement of the fourth movable member;

passing the working substance from the fourth movable member to the third movable member, the movement of the third movable member causing the compression of the working substance;

directing the working substance exiting the third primary heat exchanger to the first movable member, the heat of the working substance being removed such that the working substance compresses, causing movement of the first movable member;

passing the working substance from the first movable member through the second supplementary heat exchanger to remove additional heat from the working substance through a heat exchange with a source of cold in the external environment;

directing the working substance exiting the second supplementary heat exchanger to the second movable member, the second movable member compressing the working substance;

passing the working substance from the second movable member through the second primary heat exchanger and the first primary heat exchanger to remove sufficient heat to liquefy the working substance;

returning the working substance exiting the first primary heat exchanger to the cold source.

11. The method according to claim 10, further comprising the step of passing the working substance from the fourth movable member to the third movable member comprises expelling the working substance from the fourth movable member to the external environment and drawing a replacement working substance from the external environment into the third movable member.

12. The method according to claim 10, further comprising the step of passing the working substance from the fourth movable member to the third movable member comprises passing the working substance through the first supplementary heat exchanger.

13. A Carnot engine comprising:

a heat source;

a cold source;

a first transfer path for circulation of a working substance capable of adiabatic and isothermal expansion from the cold source to the heat source;

a second transfer path for circulation of the working substance from the heat source to the cold source;

a series of movable members that move in response to expansion or compression of the working substance as the working substance circulates between the cold source and the heat source and between the heat source and the cold source;

a series of primary heat exchangers for effecting a heat exchange between the first transfer path and the second transfer path to perpetuate the Carnot cycle by cooling in sequential stages the working substance flowing from the heat source to the cold source and heating in sequential stages the working substance flowing from the cold source to the heat source, each heat exchanger having a first flow path which forms part of the first transfer path and a second flow path which forms part of the second transfer path;

at least one supplementary heat exchanger for effecting a heat exchange between an external environment and at least one of the first transfer path or the second transfer path;

a cylindrical assembly of concentric nested components with the series of movable members moving back and forth in reciprocating fashion along a rotational axis of the cylindrical assembly; and a crank with a mechanical connection to each movable member to convert the reciprocating movement of the series of movable members into rotational movement of the crank.

14. The Carnot engine according to claim 13, wherein the crank is a crank sleeve that overlies the series of movable members and the mechanical connection is a guide track engagement on an exterior surface of each movable member and on an interior surface of the crank sleeve to convert the reciprocating movement of series of movable members into rotational movement of the crank sleeve.

15. The Carnot engine according to claim 13, wherein a flywheel is incorporated into the cylindrical assembly to increase the inertial forces maintaining rotation of the cylindrical assembly.

16. The Carnot engine according to claim 13, wherein there is provided a first section, a second section, a third section, and a fourth section, the each section having a double-acting piston pump containing one of the movable members, each side of each piston pump having one way valves to allow gas to enter through a first one way valve and be expelled though a second one way valve.

17. A Carnot engine comprising:

a heat source in the form of a heat pump that produces the highest internal temperature within the Carnot engine;

a cold source in the form of a container holding a working substance, the working substance being a cryogenic working substance which, when heated, goes from a liquid phase to a gas phase with resulting isothermal and adiabatic expansion and, when cooled, goes from a gas phase to a liquid phase resulting in isothermal and adiabatic compression, and the cold source is a container holding the working substance in liquid form;

a cylindrical assembly of a series of axially spaced sections including a first section, a second section, a third section and a fourth section, each axially spaced section formed of concentric nested components, the cylindrical assembly comprising:

a first transfer path for circulation of the working substance through the series of axially spaced sections from the cold source to the heat source;

a second transfer path for circulation of the working substance through the series of axially spaced sections from the heat source to the cold source;

a series of primary heat exchangers, including a first primary heat exchanger, a second primary heat exchanger, a third primary heat exchanger and a fourth primary heat exchanger for effecting a heat exchange between the first transfer path and the second transfer path to perpetuate the Carnot cycle by cooling in sequential stages the working substance flowing from the heat source to the cold source and heating in sequential stages the working substance flowing from the cold source to the heat source, each heat exchanger having a first flow path which forms part of the first transfer path and a second flow path which forms part of the second transfer path;

a series of double acting piston pumps having movable members moving back and forth in reciprocating fashion along a rotational axis of the cylindrical assembly, including a first pump with a first movable member, a second pump with a second movable member, a third pump with a third movable member and a fourth pump with a fourth movable member, the fourth pump being the heat source, each movable member moving in response to isothermal or adiabatic expansion or compression of the working substance as the working substance circulates between the heat source and the cold source and between the cold source and the heat source, each side of each piston pump having one way valves to allow gas to enter through a first one way valve and be expelled though a second one way valve;

a first supplementary heat exchanger for effecting a heat exchange between a source of heat in an external environment and the first transfer path;

a second supplementary heat exchanger for effecting a heat exchange between a source of cold in the external environment and the second transfer path; and a crank sleeve that overlies the series of movable members with a mechanical connection to each movable member to convert the reciprocating movement of the series of movable members into rotational movement of the crank sleeve, the mechanical connection being a guide track engagement on an exterior surface of each movable member and on an interior surface of the crank sleeve; and a series of flywheels incorporated into each section of the cylindrical assembly to increase the inertial forces maintaining rotation of the crank sleeve.

18. A Carnot engine comprising:

a first section having a first piston pump and a first heat exchanger;

a second section having a second piston pump and a second heat exchanger;

a third section having a third piston pump and a third heat exchanger;

a fourth section having a fourth piston pump and a fourth heat exchanger;

each piston pump being a double-acting piston pump, each piston pump being in thermal communication with the respective heat exchanger, each side of the piston pump having an inlet one-way valve, and an outlet one-way valve;

a first working substance path having a first expansion path and a first compression path, the first working substance path being in communication with a first cold source of a first working substance;

a second working substance path having a second expansion path and a second compression path, the second working substance path being in communication with a second cold source of a second working substance, each of the first working substance and the second working substance expanding upon the application of heat, and contracting upon the removal of heat;

a first supplementary heat exchanger for warming the first working substance in the first expansion path and the second working substance in the second expansion path;

a second supplementary heat exchanger for removing heat from the first working substance in the first compression path and the second working substance in the second compression path;

wherein:

in the first expansion path, the first working substance is released from the first cold source and absorbs heat in each of the first heat exchanger, the second heat exchanger, and the fourth piston pump, such that the expanding first working substance in the fourth piston pump causes the fourth piston pump to move in a first direction, the movement of the fourth piston pump in a second direction expelling the heated first working substance from the fourth piston pump into the first supplementary heat exchanger;

in the first compression path, the first working substance is received from the first supplementary heat exchanger by the third piston pump, the movement of the third piston pump in a first direction compressing the first working substance such that the temperature is raised, the compressed first working substance depositing heat as it passes through the fourth heat exchanger, the third heat exchanger, the first piston pump, the second supplemental heat exchanger, the second piston pump and the first heat exchanger, the first working substance in the first piston pump causing the first piston pump to move in a first direction as the first working substance contracts, the first working substance being compressed by movement of the second piston pump in a first direction prior to depositing heat in the first heat exchanger and being returned to the first cold source;

in the second expansion path, the second working substance is released from the second cold source, and absorbs heat in each of the third heat exchanger, the fourth heat exchanger, and the fourth piston pump, such that the expanding second working substance in the fourth piston pump causes the fourth piston pump to move in the second direction, the movement of the fourth piston pump in the first direction expelling the heated second working substance from the fourth piston pump into the first supplemental heat exchanger;

in the second compression path, the second working substance is received from the first supplemental heat exchanger by the third piston pump, the movement of the third piston pump in a second direction compressing the second working substance such that the temperature is raised, the compressed second working substance depositing heat in the fourth heat exchanger, the third heat exchanger, the first piston pump, the second heat exchanger, and the first heat exchanger, the cooling working substance in the first piston pump causing the first piston pump to move in a second direction as the working substance contracts, the cooling working substance being compressed by movement of the second piston pump in a second direction prior to depositing heat in the first heat exchanger and being returned to the second cold source; and means for converting the movement of the piston pumps into useful work.

19. The Carnot engine according to claim 18, wherein the means for converting the movement of the piston pumps into useful work comprises:

a crank sleeve that overlies the double-acting piston pumps with a mechanical connection to each movable member to convert the reciprocating movement of the double-acting piston pumps into rotational movement of the crank sleeve, the mechanical connection being a guide track engagement on an exterior surface of each movable member and on an interior surface of the crank sleeve; and a series of flywheels increase the inertial forces maintaining rotation of the crank sleeve.

20. The Carnot engine according to claim 18, wherein the second supplementary heat exchanger removes heat from at least one of the first working substance and the second working substance by venting the at least one of the first working substance and the second working substance to the atmosphere and drawing in a replacement substance from the atmosphere.

* * * * *